United States Patent [19]

Benson et al.

[11] 4,040,988

[45] Aug. 9, 1977

[54] BUILDER SYSTEM AND DETERGENT PRODUCT

[75] Inventors: Richard W. Benson, Cincinnati; Steven D. Cherney, Springdale; Everett J. Collier, Cincinnati, all of Ohio

[73] Assignee: The Procter & Gamble Company, Cincinnati, Ohio

[21] Appl. No.: 509,866

[22] Filed: Sept. 27, 1974

[51] Int. Cl.[2] ..... E11D 3/065

[52] U.S. Cl. ..... 252/532; 252/DIG. 11; 252/135; 252/140; 252/165; 252/531; 252/534; 252/539; 252/551

[58] Field of Search ..... 252/532, 531, 534, 140, 252/527, 165, 135, DIG. 11, 539, 551

[56] References Cited

U.S. PATENT DOCUMENTS

| | | | |
|---|---|---|---|
| 3,166,513 | 1/1965 | Mizuno et al. | 252/99 |
| 3,597,361 | 8/1971 | Sumner | 252/558 |
| 3,957,695 | 5/1976 | Davies et al. | 252/135 H |

FOREIGN PATENT DOCUMENTS

| | | |
|---|---|---|
| 2,321,001 | 11/1973 | Germany |

*Primary Examiner*—Mayer Weinblatt

*Attorney, Agent, or Firm*—Robert B. Aylor; Thomas H. O'Flaherty; Richard C. Witte

[57] ABSTRACT

A builder system is provided for detergent compositions which comprises a precipitating builder, a crystallization seed, a sequestering builder, and an alkali metal silicate. The builder system may be formulated with a detergent and other components or may be used separately as an additive product.

37 Claims, No Drawings

BUILDER SYSTEM AND DETERGENT PRODUCT

BACKGROUND OF THE INVENTION

1. Field of the invention

This invention relates to a builder system for use in detergent products.

2. Description of the prior art practices

Detergent manufacturers have long recognized the need to control water hardness to ensure adequate cleaning by detergents. Even those detergent products which are not particularly hardness sensitive require some detergent builder to prevent the precipitation onto fabrics of water hardness ions particularly at the sites of body soil stains.

The detergency builders employed in the past have been of two main types, namely, sequestering builders and precipitating builders. Sequestering builders are true chelating agents which complex water hardness ions, mainly calcium and magnesium, to lessen the ability of such ions to interfere with the detergency process. Examples of commonly used sequestering builders are the water-soluble salts of pyrophosphates, tripolyphosphates, and nitrilotriacetates. Granular detergent products sold today in the United States contain up to about 50% by weight of the aforementioned phosphate salts. The use of water-soluble phosphate salts as detergency builders has been under criticism because phosphates are believed to accelerate eutrophication, or aging of natural water bodies. Unfortunately, most other sequestering builders are unable to control hardness as effectively as the water-soluble pyrophosphate and tripolyphosphate salts in amounts which are feasible for use in a detergent composition.

Alternatively, some detergent manufacturers have turned to the use of precipitating builders such as the water-soluble salts of carbonates and silicates to achieve water-hardness control. It is noted at this point that while the water-soluble salts of carbonates and silicates are classed as precipitating builders, these materials may also associate with the waterhardness ions in a wash solution.

The presence of soluble carbonates or soluble pyrophosphates, when used separately as builders, results in the deposition of the respective insoluble calcium salts of both upon the washed fabrics.

It has been previously suggested in British Pat. No. 607,274 (Madsen), Canadian Pat. No. 511,607 (Cocks et al.), and Belgian Pat. No. 798,856 (Jacobsen et al.) herein incorporated by reference that the rate of depletion of hardness ions from a wash solution may be increased by the use of crystallization seeds in conjunction with the precipitating builder. The crystallization seeds function as growth sites for the hardness ions and the anion of the precipitating builder. Calcium carbonate crystallization seeds are most desirable in that they are inexpensive and relatively easy to process as well as being an excellent growth site for calcium salts, particularly those having a carbonate anion. The deficiency in using calcium carbonate crystallization seeds in combination with water-soluble carbonates, bicarbonates, and sesquicarbonates is that although the system is very efficient in rapidly reducing the level of soluble calcium, the remainder of the hardness ions present, particularly magnesium, are too soluble to permit precipitation with the aforementioned water-soluble salts. The term "soluble calcium" which is used interchangeably with free calcium ions includes free divalent calcium ions as well as ion pairs, such as monomolecular calcium carbonate, which are in rapid equilibrium with the calcium ion.

In an article, Effect of Impurities on Precipitation of Calcium, by Schonfeld, in the Journal of the American Water Works Association, June 1964, pp. 767–773, it is stated that as little as from 1.5 to 3.0 ppm of sequestering builders such as hexametaphosphate, phyrophosphate, and orthophosphate will effectively negate the ability of as much as 5,000 ppm of a precipitating builder such as sodium carbonate to rapidly remove soluble calcium from solution. It is also known that slightly higher concentrations of materials such as soluble ethylenediaminetetraacetate, ammonium oxylate, sodium tripolyphosphate, and other sequestering builders will also have a substantial effect on the ability of a precipitating builder such as sodium carbonate to deplete free calcium from a wash solution.

It is further known that minute amounts of materials such as the water-soluble pyrophosphates, tripolyphosphates, and other sequestering builders will upon intimate contact with the calcium carbonate crystallization seeds render the seeds ineffective in accelerating the rate of calcium depletion. Stated otherwise, sequestering builders poison the crystallization seeds to such an extent that the precipitating builder effectively functions alone. The amount of sequestering builder or similar material which render the calcium carbonate crystallization seed ineffective will vary with the type of material, i.e., sequestering builder employed. It is generally sufficient to say that when the sequestering builder or the inhibiting material is in intimate contact with the calcium carbonate crystallization seed that as little as 1.5 ppm is sufficient to poison the crystallization seed rendering it ineffective. For instance, 1.5 ppm of sodium pyrophosphate in an aqueous slurry is sufficient to adsorb over the entire surface area of a 0.25 micron calcium carbonate crystallization seed which is present at 60 ppm. Since the crystallization seed level above corresponds to 5% by weight in a typical detergent product when used at suggested levels, it would appear necessary to reduce the level of phosphate to the point at which it would be ineffective as a builder in a detergent product.

Alkali metal silicates are also known to adsorb onto calcium carbonate particles to render the latter ineffective as a crystallization seed. The aformentioned silicates are also desirable in detergent compositions to prevent washing machine corrosion and to aid in detergency. Alkali metal silicates are generally classed as precipitating builder salts.

It has been discovered that it is possible to formulate a detergent builder system or complete detergent product utilizing a crystallization seed, a precipitating builder, namely water-soluble carbonates, bicarbonates, or sesquicarbonates, a sequestering builder, and an alkali metal silicate. Contrary to what one would expect from the prior art, it has been found that substantial amounts of sequestering builders such as water-soluble salts of pyrophosphates, tripolyphosphates, nitrilotriacetates, and an alkali metal silicate may be present in a wash solution at the same time as the calcium carbonate crystallization seed and the aforementioned precipitating builder salts without substantially interfering with the removal of soluble calcium by precipitation. While some effect on the precipitation of soluble calcium will occur from the use of the sequestering builders, it is much less than one would predict upon comparing the individual effect of these builders upon systems containing the aforementioned precipitating builder salts or the separate effect on the growth of crystallization seeds such as is observed in the processes for the manufacture of commercial calcium carbonate.

It has been surprisingly discovered that the benefits of the present invention in maintaining calcium and magnesium ion control in the wash solution allows for satisfactory detergency results in low or no phosphate detergent compositions.

Another advantage to the present invention in its low phosphate aspect compared to non-phosphate detergent products is that the former gives granules which are more resistant to humidity caking.

The benefits of the present invention in its non-phosphate aspect allow the use of expensive sequestering builders at amounts much lower than would otherwise be required to achieve waterhardness control. In the case of non-phosphate compositions of the present invention it is also possible to use sequestering builders which are economically attractive but which lack the water-hardness sequestration ability of the water-soluble pyrophosphates and tripolyphosphates.

It has also been observed that water-soluble pyrophosphates may be incorporated in the present invention without substantial calcium pyrophosphate precipitation upon fabrics. Pyrophosphate may be present as a builder or from reversion of higher polyphosphate species. Similarly, calcium carbonate deposition upon fabrics is greatly diminished in the present invention despite the addition of large amounts of calcium carbonate particles.

In the concurrently filled, commonly assigned application of Everett J. Collier entitled BUILDER SYSTEM AND DETERGENT PRODUCT, Ser. No. 509,865, herein incorporated by reference, it is recognized that the sequestering builder need not be delayed from entering solution until after the precipitating builder and crystallization seed have functioned. While the composition performs adequately without such delay, it has been found that better performance is obtained when delay is accomplished by the manner hereinafter described. Delaying the solution of the granule containing the sequestering builder is accomplished by including in the slurry from which the granule is formed an amount of alkali metal silicate of the formula $M_2O$:-$SiO_2$ with the ratio being from about 1:2 to about 1:3.75 where M is the alkali metal. Ordinarily the $M_2O$:$SiO_2$ ratio in detergent products is from 1:1 to 1:2.4. Additionally, the alkali metal silicate in the product at the aforementioned ratios does not substantially interfere with the crystallization seed in the wash.

Throughout the specification and claims, percentages and ratios are given by weight unless otherwise indicated and temperatures are in Fahrenheit degrees.

SUMMARY OF THE INVENTION

The invention as a detergent additive therefore comprises:

a. from about 0.5% to about 60% by weight of submicron calcium carbonate particles;
b. from about 0.5% to about 80% by weight of a first builder component selected from the group consisting of the alkali metal carbonates, bicarbonates, and sesquicarbonates and mixtures thereof,
c. from about 5% to about 70% by weight of a sequestering builder and mixtures thereof; and,
d. from about 5% to about 40% by weight of an alkali metal silicate having a $M_2O$:$SiO_2$ ratio of from about 1:2 to about 1:3.75 wherein M is an alkali metal; wherein component (a) and component (b) are combined to form one discrete granule, and component (c) and component (d) are present as a second discrete granule The second aspect of this invention is a granular detergent product comprising:

a. from about 0.5% to about 50% by weight of submicron calcium carbonate particles;
b. from about 5% to about 70% by weight of a first builder component selected from the group consisting of the alkali metal carbonates, bicarbonates, and sesquicarbonates and mixtures thereof;
c. from about 5% to about 70% by weight of a sequestering builder and mixtures thereof;
d. from about 5% to about 40% by weight of an alkali metal silicate having a $M_2O$:$SiO_2$ ratio of from about 1:2 to about 1:3.75 wherein M is an alkali metal; and,
e. from about 5% to about 40% by weight of a water-soluble detergent selected from the group consisting of anionic, nonionic, zwitterionic, and ampholytic detergents and mixtures thereof; wherein component (a) and component (b) are combined to form one discrete granule, and component (c) and component (d) are present as a second discrete granule.

The detergent composition of the present invention allows the incorporation of calcium carbonate crystallization seeds in a form which retains their high effective surface area and a large number of discrete particles which are beneficial in the depletion of soluble calcium in the wash solution while providing a convenient manner for incorporating dusty calcium carbonate particles into the composition.

DETAILED DESCRIPTION OF THE INVENTION

The present invention comprises submicron calcium carbonate crystallization seeds which have been prepared in the form of a granular matrix with a precipitating builder component selected from the group consisting of the alkali metal carbonates, bicarbonates, and sesquicarbonates and mixtures thereof. Throughout the specification and claims, the term "first builder component" refers to the above-mentioned carbonate, bicarbonate, and sesquicarbonate salts.

The calcium carbonate crystallization seed employed in this invention may be of the calcite, aragonite, or vaterite crystal structure, most preferably calcite. The amount of calcium carbonate crystallization seed present is dependent upon a variety of factors, for example, the mean particle diameter of the crystals, the nominal surface area, the temperature of the wash water, and the particular choice and amount of the precipitating builder to be used with the crystallization seed. As the crystallization seed functions by providing growth sites for the soluble calcium ions to precipitate upon, the nature of the crystal surface of the seed is most important.

The nominal surface area of the crystallization seed is a physical measurement of the total surface area. The effective surface area of a crystallization seed is directly proportional to the amount of soluble calcium which is depleted in a specified time from the wash solution by a given weight of calcium carbonate crystallization seed when used in combination with the precipitating builder of the present invention. Crystallization seeds which have been poisoned, for example, by sodium tripolyphophate will have the same nominal surface area as unpoisoned crystallization seeds but will have an effective surface area near zero. The most meaningful measure of the effective surface area is the mean particle diameter of the crystallization seed, as the mean diameter for any given crystal form dictates the surface area and the number of crystallization seeds. The surface area per unit mass is inversely proportional to the mean particle diameter, thus smaller mean particle diameters provide higher effective surface area crystallization seeds.

Calcium carbonate crystallization seeds which are suitable for use in the present invention are available under the trade name Purecal O, Purecal T, and Purecal U sold by the Wyandotte Chemical Company. Other methods of preparing calcium carbonate crystallization seeds suitable for use in the present invention are found in U.S. Pat. No. 2,981,596 entitled "Preparation of Alkaline Earth Carbonates" issued to Raymond R. McClure, patented Apr. 25, 1961, herein incorporated by reference.

The calcium carbonate crystallization seed particles are prepared in the granular matrix by the process described in the concurrently-filed, commonly-assigned U.S. Pat. Applications 509,863 (now U.S. Pat. No. 3,992,314, patented Nov. 16, 1976) and 509,864 entitled respectively "Process for the Preparation of Spray-Dried Calcium Carbonate-Containing Granules" and "Calcium Carbonate-Containing Granules" to Cherney, herein incorporated by reference.

Basically the calcium carbonate-containing granule is prepared by taking submicron calcium carbonate crystallization seeds preferably having a mean particle diameter of from about 0.01 micron to about 0.50 micron, more preferably from about 0.01 micron to about 0.25 micron, and most preferably from about 0.01 micron to about 0.10 micron and forming a slurry thereof with the water-soluble precipitating builder salt in a weight ratio of water-soluble precipitating builder to calcium carbonate of from about 1:2 to about 75:1, preferably from about 1:1 to about 50:1, and most preferably from about 2:1 to about 10:1. The aqueous slurry containing the calcium carbonate crystallization seed particles and the water-soluble precipitating builder is then spray-dried by conventional spray-drying methods to eliminate substantially all of the water present. The amount of water in the aqueous slurry is from about 20% to about 95% by weight, preferably from about 30% to about 90%, and most preferably from about 40% to about 80% by weight. Minor amounts of diluent salts such as sodium chloride or sodium sulfate may be present along with the water-soluble precipitating builder salt in the aqueous slurry.

The water-soluble precipitating builder salts of the present invention are the alkali metal carbonates, bicarbonates, and sesquicarbonates, and in particular the sodium and potassium carbonate. While it is desirable to form the calcium carbonate-containing granule such that all of the precipitating builder salt is contained within the calcium carbonate-containing granule, it is possible to formulate either the additive product or the detergent composition by admixing additional quantities of the water-soluble precipitating builder salt with the other components in dry form. Alternatively, additional amounts of the water-soluble precipitating builder salt may be incorporated into the additive product or the detergent composition by forming a slurry of the sequestering builder or the sequestering builder and detergent component and including therewith a portion of the water-soluble precipitating builder. In either of the preceding cases, the additional precipitating builder is present at from about 5 to about 60%, preferably from about 10 to about 30% by weight of the finished product.

In an additive product, the total amount of calcium carbonate crystallization seed particles present is from about 0.5% to about 60%, preferably from about 1% to about 40%, and most preferably from about 2% to about 30% by weight of the total composition. The amount of water-soluble precipitating builder in an additive product is from about 0.5% to about 80%, preferably from about 5% to about 60%, and most preferably from about 10% to about 50% by weight of the total composition.

The additive product will also contain the sequestering builder at from about 5% to about 70%, preferably from about 10% to about 60%, and most preferably from about 15% to about 50% by weight of the total composition.

The sequestering builder granule in the additive or detergent product is made by preparing a slurry of the sequestering builder and the alkali metal silicate forming a granule by spray-drying, agglomeration, or drum-drying. Preferably the sequestering builder and the alkali metal silicate is prepared by spray-drying, particularly by the method disclosed in U.S. Patent No. 3,629,951 entitled "Multilevel Spray-Drying Method" issued Dec. 28, 1971, to Robert P. Davis et al.

The alkali metal silicate in the additive or detergent product has a $M_2O:SiO_2$ ratio of from about 1:2 to about 1:3.75, preferably from about 1:2.4 to about 1:3.5, most preferably from about 1:2.6 to about 1:3.3 wherein M is the alkali metal. The alkali metal silicate, preferably sodium or potassium, is present at from about 5% to about 40%, preferably from about 10% to about 85%, and most preferably from about 15% to about 30% by weight in the detergent or additive product. It is usually desirable to have all the detergent components present immediately in a wash solution; however, the poisoning of the crystallization seeds by the sequestering builders makes some delay desirable. The alkali metal silicates having the $M_2O:SiO_2$ ratios listed above when spray-dried with the sequestering builder delay the solubility of the granule so formed. The delay effect is unique in that one material known to poison calcium carbonate crystallization seeds is delayed from entering the wash solution by a second material which is known for its ability to poison calcium carbonate crystallization seeds.

When a detergent composition is to be formulated using the builder system of the present invention, the calcium carbonate-containing granule is prepared as described above. In a detergent composition, the amount of calcium carbonate crystallization seed present is from about 0.5 to about 50%, preferably from about 1% to about 40%, and most preferably from about 2% to about 30% by weight. The amount of water-soluble precipitating builder is from about 5% to about 70%, preferably from about 10% to about 60%, and most preferably from 15% to about 50% by weight.

The amount of sequestering builder present in the detergent composition of the present invention is from about 5% to about 70%, preferably from about 10% to about 60%, and most preferably from about 15% to about 50% by weight. The detergent component of the present invention is present in the composition at from about 5% to about 40%, preferably from about 10% to about 30%, and most preferably from about 12% to about 25% by weight. The detergent component and the sequestering builder are preferably processed together to avoid any interference by the detergent component with the calcium carbonate crystallization seed.

The detergent product of the present invention may also include without limitation, components ordinarily found in detergent compositions such as bleaches, brighteners, hydrotropes, and anticaking agents which are preferably processed into the detergent-containing granule.

The sequestering builders of the present invention are, for example, water-soluble phosphates, pyrophosphates, orthophosphates, polyphosphates, phosphonates, polyhydroxysulfonates, polyacetates, carboxylates, polycarboxylates, and succinates. Specific examples of inorganic phosphate builders include sodium and potassium tripolyphosphates, pyrophosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid and the sodium and potassium salts of ethane-1,1,2-triphosphonic acid. Examples of these and other phosphorous builder compounds are disclosed in U.S. Pat. 3,159,581; 3,213,030; 3,422,021; 3,422,137; 3,400,176; and 3,400,148, incorporated herein by reference.

Water-soluble, organic sequestering builders are also useful herein. For example, the alkali metal, ammonium and substituted ammonium polyacetates, carboxylates, polycarboxylates, and polyhydroxysulfonates are useful sequestering builders in the present compositions. Specific examples of the polyacetate and polycarboxylate builder salts include sodium potassium, lithium, ammonium and substituted ammonium salts of ethylene diamine tetraccetic acid, nitrilotriacetic acid, oxydisuccinic acid, mellitic acid, benzene polycarboxylic acids, and citric acid.

Highly preferred non-phosphorus sequestering builder materials herein include sodium citrate, sodium oxydisuccinate, sodium mellitate, sodium nitrilotriacetate, and sodium ethylene diamine tetraccetate and mixtures thereof.

Other highly preferred sequestering builders herein are the polycarboxylate builders set forth in U. S. Pat. No. 3,308,067, Diehl, incorporated herein by reference. Examples of such materials include the water-soluble salts of the homo- and co-polymers of aliphatic carboxylic acids such as maleic acid, itaconic acid, mesaconic acid, fumaric acid, aconitic acid, citraconic acid, methylenemalonic acid, 1,1,2,2-ethane tetracarboxylic acid, dihydroxy tartaric acid, and keto-malonic acid.

Additional preferred sequestering builders herein include the water-soluble salts, especially the sodium and potassium salts of carboxy methyloxymalonate, arboxymethyloxysuccinate, cis-cyclohexanehexacarboxylate, cis-cyclopentanetetracarboxylate, and phloroglucinol trisulfonate.

Most preferably the sequestering builder of the present invention is a water-soluble salt, particularly sodium and potassium tripolyphosphates, pyrophosphates, and nitrilotriacetates.

DETERGENT COMPONENT

Preferably the detergent component of the instant invention is a water-soluble salt of: an sulfated ethoxylated alcohol with an average degree of ethoxylation of about 1 to 4 and an alkyl chain length of about 14 to 16; tallow triethoxy sulfate; tallow alcohol sulfates; an alkyl benzene sulfonate with an average alkyl chain length between 11 and 12, preferably 11.2 carbon atoms; an $\alpha$-sulfocarboxylic acid or ester thereof having from 8 to 20 carbon atoms in the acid radical and from 1 to 13 carbon atoms in the alcohol radical; a $C_8$–$C_{24}$ paraffin sulfonate; a $C_{10}$–$C_{24}$ $\alpha$-olefin sulfonate or mixtures thereof; or other anionic sulfur-containing surfactant. Such preferred surfactants are discussed below.

An especially preferred alkyl ether sulfate detergent component of the instant compositions is a mixture of alkyl ether sulfates, said mixture having an average (arithmetic mean) carbon chain length within the range of from about 12 to 16 carbon atoms, preferably from about 14 to 15 carbon atoms, and an average (arithmetic mean) degree of ethoxylation of from about 1 to 4 moles of ethylene oxide, preferably from about 2 to 3 moles of ethylene oxide. Specifically, such preferred mixtures comprise from about 0 to 20% by weight of mixture of $C_{12-13}$ compounds, from about 60% to 100% by weight of mixture of $C_{14-15-16}$ compounds, and from about 0 to 20% by weight of mixture of $C_{17-18-19}$ compounds. Further, such preferred alkyl ether sulfate mixtures comprise from about 3% to 30% by weight of mixture of compounds having a degree of ethoxylation of 0, from about 45% to 90% by weight of mixture of compounds having a degree of ethyoxylation from 1 to 4, from about 10% to 25% by weight of mixture of compounds having a degree of ethoxylation from 5 to 8 and from about 0.1% to 15% by weight of mixture of compounds having a degree of ethoxylation greater than 8. The sulfated condensation products of tallow alcohol with from 1 to 30, conveniently 1 to 10 and preferably 1 to 4 moles of ethylene oxide may be used in place of the preferred alkyl ether sulfates discussed above.

Another class of detergents includes water-soluble salts, particularly the alkali metal, ammonium and alkylolammonium salts of organic sulfuric reaction products having in their molecular structure an alkyl group containing from about 8 to about 22 carbon atoms and a sulfuric acid ester group. Examples of this group of synthetic detergents which form a part of the detergent compositions of the present invention are the sodium and potassium alkyl sulfates, especially those obtained by sulfating the higher alcohols ($C_8$–$C_{18}$ carbon atoms) produced by reducing the glycerides of tallow or coconut oil.

Preferred water-soluble organic detergent compounds herein include linear alkyl benzene sulfonates contaning from about 9 to 15 carbon atoms in the alkyl group. Examples of the above are sodium and potassium alkyl benzene sulfonates in which the alkyl group contained from about 11 to about 13 carbon atoms, in straight chain or branched chain configuration, e.g. those of the type described in U.S. Pat. Nos. 2,220,009 and 2,477,383. Especially valuable are straight chain alkyl benzene sulfonates in which the average of the alkyl group is about 11.2 carbon atoms, abbreviated as $C_{11.2}$LAS.

Another useful detergent compound herein includes the water-soluble salts of esters of $\alpha$-sulfonated fatty acids containing from about 6 to 20 carbon atoms in the fatty acid group and from about 1 to 10 carbon atoms in the ester group.

Preferred "olefin sulfonate" detergent mixtures utilizable herein comprise olefin sulfonates containing from about 10 to about 24 carbon atoms. Such materials can be produced by sulfonation of α-olefins by means of uncomplexed sulfur trioxide followed by neutralization under conditions such that any sultones present are hydrolyzed to the corresponding hydroxy-alkane sulfonates. The α-olefin starting materials preferably have from 14 to 16 carbon atoms. Said preferred α-olefin sulfonates are described in U.S. Pat. No. 3,332,880, incorporated herein by reference.

The paraffin sulfonates embraced in the present invention are essentially linear and contain from 8 to 24 carbon atoms, preferably 12 to 20 and more preferably 14 to 18 carbon atoms in the alkyl radical.

Other anionic detergent compounds herein include the sodium alkyl glyceryl ether sulfates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Water-soluble salts of the higher fatty acids, i.e. "soaps", are useful as the detergent component of the composition herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e. sodium or potassium tallow and coconut soap.

Water-soluble nonionic synthetic detergents are also useful as the detergent component of the instant composition. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name "Pluronic" sold by Wyandotte Chemicals. These compounds are formed by condensing ethylene oxide with a hydrophobic base formed by the condensation of propylene oxide with propylene glycol. Other suitable nonionic synthetic detergents include the polyethylene oxide condensates of alkyl phenols, e.g. the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol.

The water-soluble condensation products of aliphatic alcohols having from 8 to 22 carbon atoms, in either straight chain or branched configuration, with ethylene oxide, e.g. a coconut alcohol-ethylene oxide condensate having from 5 to 30 moles of ethylene oxide per mole of coconut alcohol, the coconut alcohol fraction having from 10 to 14 carbon atoms, are also useful nonionic detergents herein.

Semi-polar nonionic detergents include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Amopholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water-solubilizing group.

Other useful detergents include water-soluble salts of 2-acyloxy-alkane-1-sulfonic acids containing from about 2 to 9 carbon atoms in the acyl group and from about 9 to about 23 carbon atoms in the alkane moiety; β-alkyloxy alkane sultonates containing from about 1 to 3 carbon atoms in the alkyl group and from about 8 to 20 carbon atoms in the alkane moiety; alkyl dimethyl amine oxides wherein the alkyl group contains from about 11 to 16 carbon atoms; alkyldimethyl-ammonio-propane-sulfonates and alkyl-dimethyl-ammonio-hydroxypropane-sulfonates wherein the alkyl group in both types contains from about 14 to 18 carbon atoms; soaps as hereinabove defined; the condensation product of tallow fatty alcohol with about 11 moles of ethylene oxide; the condensation product of a $C_{13}$ (avg.) secondary alcohol with 9 moles of ethylene oxide; and alkyl glyceral ether sulfates with from 10 to 18 carbon atoms in the alkyl radical.

A typical listing of the classes and species of detergent compounds useful herein appear in U.S. Pat. No. 3,664,961, incorporated herein by reference. The following list of detergent compounds which can be used in the instant compositions is representative of such materials, but is not intended to be limiting.

It is to be recognized that any of the foregoing detergents can be used separately herein or as mixtures.

Further useful surfactants are ethoxylated zwitterionic compounds described in U.S. Pat. Application Ser. No. 493,953, now U.S. Pat. No. 3,929,678, patented Dec. 30, 1975, entitled DETERGENT COMPOSITION HAVING ENHANCED PARTICULATE SOIL REMOVAL PERFORMANCE to Laughlin and Heuring, filed Aug. 1, 1974, herein incorporated by reference, specifically including the cosurfactant disclosure in the Laughlin and Heuring Application.

A particularly useful detergent mixture which may be used in the present invention comprises:

i. from about 2% to about 15% alkyl ether sulfates of the formula

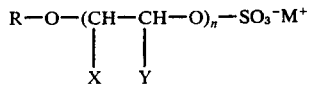

wherein R is an alkyl having from about 10-20 carbon atoms, $x$ and $y$ are selected from the group consisting of hydrogen, lower alkyls, and hydroxyl radicals and mixtures thereof; M is an alkali metal; and n is an integer from 1 to 30;

ii. from about 2% to about 15% by weight of an alkali metal salt of an alkyl sulfate wherein the alkyl group has from 10-20 carbon atoms; and, iii. from about 2% to about 15% by weight of an alkali metal salt of an alkyl benzene sulfonate wherein the alkyl group has from 9-15 carbon atoms.

It is preferred that the product components be spray-dried by the method described in U.S. Pat. No. 3,629,951 entitled *MULTILEVEL SPRAY-DRYING METHOD* to Robert P. Davis et al, issued Dec. 28, 1971. Other methods of preparing the sequestering builder granule and/or the detergent include the techniques of agglomeration or drum-drying of the former being described, for example, in U.S. Pat. No. 3,597,361 entitled *METHOD OF PREPARING AGGLOMERATED DETERGENT COMPOSITION* to Sumner, patented Aug. 3, 1971.

To further limit the solubility of the granule containing the sequestering builder, it is preferable but not necessary that the above described methods of preparing granules be carried out such that the amount of moisture left in the granule containing the sequestering builder is less than about 12% by weight of the granule, preferably less than about 7% by weight, and most preferably less than about 3% by weight.

The intended level of usage of the detergent additive or detergent product of the present invention generally will vary from one-half cup to one and one-half cups with the washing machine capacity from about 10 to about 22 gallons. Washing temperatures are preferably between about 70° and 120° F. The additive product is preferably added to the wash before the detergent product, but simultaneous addition may be employed.

The relative effectiveness of the composition of the present invention is determined by actual wash preformance, or for example by indirectly measuring amount of hardness control as is described in the copending Applications of Cherney, previously incorporated herein by reference or by specific ion electrodes. When the testing of the actual cleaning ability is desired, soiled cloth swatches are washed with the product as described above and compared to standard test swatches by means of a Hunter Whiteness meter. The product usage level in the examples is 0.12% by weight unless otherwise indicated. The following are examples of the present invention.

EXAMPLE I

The following detergent additive is prepared in accordance with the present invention.

50% by weight of a calcium carbonate-containing granule having calcium carbonate particles with a mean diameter of 0.02 micron in a weight ratio of sodium carbonate to calcium carbonate of 5:1.

45% by weight of sodium pyrophosphate combined with

5% by weight sodium silicate ($Na_2O:SiO_2$ 1:3.75) to form a second granule.

The additive composition prepared above is satisfactory in depleting hardness comprising calcium and magnesium.

Substantially equivalent performance is obtained in the present invention when sodium tripolyphosphate is substituted for the sodium pyrophosphate and the crystallization seeds have a mean diameter of 0.10 micron.

The composition of the present invention results in diminished deposition upon fabrics of calcium pyrophosphate and calcium carbonate compared to compositions utilizing sodium pyrophosphate alone or sodium carbonate alone.

EXAMPLE II

The following detergent additive is prepared in accordance with the present invention.

80% by weight of a calcium carbonate-containing granule having calcium carbonate particles with a mean diameter of 0.01 micron in a weight ratio of sodium carbonate to calcium carbonate of 75:1.

5% by weight of sodium tripolyphosphate combined with

15% by weight sodium silicate having an $Na_2O:SiO_2$ ratio of 1:2 to form a second granule.

The additive composition prepared above is satisfactory in depleting hardness comprising calcium and magnesium.

Substantially equivalent performance is obtained in the present invention when sodium nitrilotriacetate is substituted for the sodium tripolyphosphate and the crystallization seeds have a mean diameter of 0.05 micron.

EXAMPLE III

The following detergent additive is prepared in accordance with the present invention.

90% by weight of a calcium carbonate-containing granule having calcium carbonate particles with a mean diameter of 0.95 micron in a weight ratio of sodium carbonate to calcium carbonate of 1:2.

5% by weight of sodium nitrilotriacetate combined with

5% by weight potassium silicate having a $K_2O:SiO_2$ ratio of 1:2.4 to form a second granule.

The additive composition prepared above is satisfactory in depleting hardness comprising calcium and magnesium.

Substantially equivalent performance is obtained in the present invention when sodium pyrophosphate is substituted for the sodium nitrilotiracetate and the crystallization seeds have a mean diameter and 0.1 micron.

Additional granular sodium carbonate is added in the above example at levels of 5 % and 60 % by weight to give improved performance.

EXAMPLE IV

The following detergent additive is prepared in accordance with the present invention.

1% by weight of a calcium carbonate-containing granule having calcium carbonate particles with a mean diameter of 0.05 micron in a weight ratio of sodium bicarbonate to calcium carbonate of 1:1

70% by weight of sodium pyrophosphate combined with

29% by weight sodium silicate having a $Na_2O:SiO_2$ ratio of 1:2.6 to form a second granule.

The additive composition prepared above is satisfactory in depleting hardness comprising calcium and magnesium.

Substantially equivalent performance is obtained in the present invention when sodium carbonate is substituted for sodium bicarbonate; the crystallization seeds have a mean diameter of 0.02 micron; and sodium silicate is present at 40% with an $Na_2O:SiO_2$ ratio of 1:3.2 and the sodium pyrophosphate present at 59.0% by weight.

EXAMPLE V

The following detergent additive is prepared in accordance with the present invention.

30% by weight of a calcium carbonate-containing granule having calcium carbonate particles with a mean diameter of 0.03 micron in a weight ratio of sodium carbonate to calcium carbonate of 2:1.

50% by weight of a mixture of sodium tripolyphosphate and sodium nitrilotriacetate in a 1:1 weight ratio and combined with 20% by weight sodium silicate having an $Na_2O:SiO_2$ ratio of 1:2.4 to form a second granule.

The additive composition prepared above is satisfactory in depleting hardness comprising calcium and magnesium.

Substantially equivalent performance is obtained in the present invention when sodium pyrophosphate is substituted for sodium tripolyphosphate.

EXAMPLE VI

The following detergent composition is prepared in accordance with the present invention.

18% by weight of a calcium carbonate-containing granule having calcium carbonate particles with a mean diameter of 0.02 micron in a weight ratio of sodium carbonate to calcium carbonate of 5:1.

25% by weight of sodium pyrophosphate combined with

17% by weight linear alkyl benzene sulfonate with an average alkyl chain length of 11.2 carbon atoms, and 40% sodium silicate having an $Na_2O:SiO_2$ ratio of 1:3.75 to form a second granule.

The detergent composition prepared above is satisfactory in cleaning ability and in depleting water hardness comprising calcium and magnesium.

Equivalent performance is obtained in the present invention when sodium tripolyphosphate is substituted for the sodium pyrophosphate and the crystallization seeds have a mean diameter of 0.95 micron.

EXAMPLE VII

The following detergent composition is prepared in accordance with the present invention.

1.5% by weight of a calcium carbonate-containing granule having calcium carbonate particles with a mean diameter of 0.01 micron in a weight ratio of sodium carbonate to calcium carbonate of 1:2.

70% by weight of sodium pyrophosphate is combined with

5% by weight linear alkyl benzene sulfonate with an average alkyl chain length of 11.2 carbon atoms, and 23.5% sodium silicate having an $Na_2O:SiO_2$ ratio of 1:2 to form a second granule.

The detergent composition prepared above is satisfactory in cleaning ability and in depleting water hardness comprising calcium and magnesium.

Equivalent performance is obtained in the present invention when sodium nitrilotriacetate is substituted for the sodium pyrophosphate and the crystallization seeds have a mean diameter of 0.50 micron.

EXAMPLE VIII

The following detergent composition is prepared in accordance with the present invention.

38% by weight of a calcium carbonate-containing granule having calcium carbonate particles with a mean diameter of 0.025 micron in a weight ratio of sodium carbonate to calcium carbonate of 75:1.

5% by weight of sodium citrate is combined with

40% by weight linear alkyl benzene sulfonate with an average alkyl chin length of 11.2 carbon atoms, and 17% sodium silicate having an $NA_2O:SiO_2$ ratio of 1:2.6 to form a second granule.

The detergent composition prepared above is satisfactory in cleaning ability and in depleting water hardness comprising calcium and magnesium.

Equivalent performance may be enjoyed in the present invention when sodium tripolyphosphate is substituted for the sodium citrate and the crystallization seeds have a mean diameter of 0.10 micron. The composition above may be modified by adding sodium carbonate to the calcium carbonate-containing granule up to 70% $Na_2CO_3$ in a 50:1 ratio to the calcium carbonate and reducing the alkyl benzene sulfonate to 6.1% by weight.

EXAMPLE IX

The following detergent composition is prepared in accordance with the present invention.

75% by weight of a calcium carbonate-containing granule having calcium carbonate particles with a mean diameter of 0.25 micron in a weight ratio of sodium bicarbonate to calcium carbonate of 1:2.

10% by weight of sodium pyrophosphate combined with

10% by weight linear alkyl benzene sulfonate with an average alkyl chain length of 11.2 carbon atoms, and 5% sodium silicate having an $Na_2O:SiO_2$ ratio of 1:2 to form a second granule.

The detergent composition prepared is satisfactory in cleaning ability and in depleting water hardness comprising calcium and magnesium.

Equivalent performance may be enjoyed in the present invention when sodium tripolyphosphate is substituted for the sodium pyrophosphate and the crystallization seeds have a mean diameter of 0.01 micron.

EXAMPLE X

The following detergent composition is prepared in accordance with the present invention.

10% by weight of a calcium carbonate-containing granule having calcium carbonate particles with a mean diameter of 0.01 micron in a weight ratio of sodium carbonate to calcium carbonate of 1:1.

40% by weight of sodium tripolyphosphate combined with

10% by weight $C_{16}$ triethoxy sodium alkyl ether sulfate

10% by weight $C_{18}$ alkyl sodium sulfate

10% by weight $C_{12}$ linear alkyl benzene sulfonate (sodium salt), and

20% by weight sodium silicate having an $Na_2O:SiO_2$ ratio of 1:3.2 to form a second granule.

The detergent composition prepared above is satisfactory in cleaning ability and in depleting water hardness comprising calcium and magnesium.

What is claimed is:

1. A granular detergent additive consisting essentially of:

a. from about 0.5% to about 60% by weight of submicron calcium carbonate particles;

b. from about 0.5% to about 80% by weight of a first builder component selected from the group consisting of the alkali metal carbonates, bicarbonates, and sesquicarbonates and mixtures thereof;

c. from about 5% to about 70% by weight of a sequestering builder selected from the group consisting of the alkali metal pyrophosphates, tripolyphosphates, nitrilotriacetates, and citrates, and mixtures thereof; and d. from about 5% to about 40% by weight of an alkali metal silicate having a $M_2O:SiO_2$ ratio of from about 1:2 to about 1:3.75 wherein M is an alkali metal;

wherein component (a) and component (b) are combined to form one discrete granule and component (c) and component (d) are present as a second discrete granule wherein the second discrete granule is dried to a moisture content of less than about 7% by weight.

2. The composition of claim 1 wherein the mean diameter of the submicron calcium carbonate particles in the descrete granule is from about 0.01 micron to about 0.5 micron.

3. The composition of claim 2 wherein the ratio $M_2O:SiO_2$ is from about 1:2.4 to about 1:3.5.

4. The composition of claim 3 wherein the weight ratio of component (b) to the calcium carbonate in the discrete granule is from about 75:1 to about 1:2.

5. The composition of claim 4 wherein the mean diameter of the submicron calcium carbonate particles in the discrete granule is from about 0.01 to about 0.25 micron.

6. The composition of claim 5 wherein the ratio $M_2O:SiO_2$ is from about 1:2.6 to about 1:3.3 and M is sodium.

7. The composition of claim 6 wherein the weight ratio of component (b) to the calcium carbonate in the discrete granule is from about 50:1 to about 1:1.

8. The composition of claim 7 wherein component (c) is present at from about 10% to about 60% by weight.

9. The composition of claim 8 wherein component (c) is selected from the group consisting of alkali metal pyrophosphates and tripolyphosphates and mixtures thereof.

10. The composition of claim 9 wherein component (c) is present at from about 15% to about 50% by weight.

11. The composition of claim 10 wherein component (b) is sodium carbonate and component (c) is sodium pyrophosphate.

12. The composition of claim 11 wherein the mean diameter of the submicron calcium carbonate particles in the discrete granule is from about 0.01 to about 0.10 micron and the weight ratio of the sodium carbonate to the calcium carbonate in the discrete granule is from about 10:1 to 2:1.

13. The composition of claim 4 additionally consisting essentially of from about 5% to about 60% by weight of the finished product of a detergent builder selected from the group consisting of alkali metal carbonates, bicarbonates, and sesquicarbonates, and mixtures thereof.

14. The composition of claim 13 wherein the additional detergent builder is selected from the group consisting of sodium carbonate, sodium bicarbonate, and sodium sesquicarbonate and mixtures thereof.

15. A granular detergent product consisting essentially of:

a. from about 0.5% to about 50% by weight of submicron calcium carbonate particles;

b. from about 5% to about 70% by weight of a first builder component selected from the group consisting of the alkali metal carbonates, bicarbonates, and sesquicarbonates and mixtures thereof;

c. from about 5% to about 70% by weight of a sequestering builder selected from the group consisting of the alkali metal pyrophosphates, tripolyphosphates, nitrilotriacetates, and citrates, and mixtures thereof;

d. from about 5% to about 40% by weight of an alkali metal silicate having a $M_2O:SiO_2$ ratio of from about 1:2 to about 1:3.75 wherein M is an alkali metal; and e. from about 5% to about 40% by weight of a water-soluble detergent selected from the group consisting of anionic, nonionic, zwitterionic, and ampholytic detergents, and mixtures thereof;

wherein component (a) and component (b) are combined to form one discrete granule and components (c), (d), and (e) are present as a second discrete granule wherein the second discrete granule is dried to a moisture content of less than 7% by weight.

16. The composition of claim 15 wherein component (e) is selected from the group consisting of non-soap anionic and nonionic detergents.

17. The composition of claim 16 wherein the mean diameter of the submicron calcium carbonate particles in the discrete granule is from about 0.01 micron to about 0.5 micron.

18. The composition of claim 17 wherein component (e) is selected from the group consisting of:

a. alkyl ether sulfates of the formula

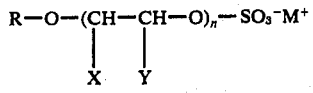

wherein R is an alkyl having from about 10–20 carbon atoms; x and y are selected from the group consisting of hydrogen, lower alkyls, and hydroxyl radicals and mixtures thereof; and n, the average degree of ethoxylation, is an integer from 1 to 30;

b. alkali metal salts of an alkyl sulfate wherein the alkyl group has from 8–18 carbon atoms;

c. alkali metal salts of an alpha-olefin sulfonate wherein the alkyl group has from 10–24 carbon atoms;

d. alkali metal salts of an alkyl benzene sulfonate wherein the alkyl group has from 9–15 carbon atoms;

e. mixtures of alpha-sulfo carboxylic acids and esters thereof of the formula

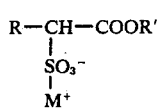

wherein R is an alkyl having from 10–20 carbon atoms and R' is selected from the group consisting of hydrogen, $M^+$, and alkyls having from 1–13 carbon atoms; and f. ethoxylated alcohols of the formula

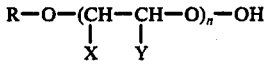

wherein R is an alkyl having from 6–20 carbon atoms; $x$ and $y$ are selected from the group consisting of hydrogen, lower alkyls, and hydroxyl radicals and mixtures thereof; and $n$ is an integer from 1 to 30; and mixtures thereof, wherein M is an alkali metal.

19. The composition of claim 18 wherein the weight ratio of component (b) to the calcium carbonate in the discrete granule is from about 75:1 to about 1:2.

20. The composition of claim 19 wherein the detergent component is an alkyl ether sulfate wherein $x$ and $y$ are hydrogen, M is selected from the group consisting of sodium and potassium, and the average number of carbon atoms is R within said alkyl ether sulfate mixture varying between 12 and 16 and $n$ the average degree of the ethoxylation of said mixture varying between 1 and 4 moles of ethylene oxide; said mixture consisting essentially from about 0% to 20% by weight of said alkyl ether sulfate mixture of compounds with R containing 12 or 13 carbon atoms; from about 60% to 100% by weight of said alkyl ether sulfate mixture of compounds with R containing 14, 15 or 16 carbon atoms; from about 0% to 20% by weight of said alkyl ether sulfate mixture of compounds with R containing 17, 18 or 19 carbon atoms, from about 3% to 30% by weight of said alkyl ether sulfate mixture of compounds having a degree of ethoxylation of zero; from about 45% to 90% by weight of said alkyl ether sulfate mixture of compounds having a degree of ethoxylation of from 1 to 4; from about 10% to 25% by weight of said alkyl ether sulfate mixture of compounds having a degree of ethoxylation of from 5 to 8; and from about 0.1% to 15% by weight of said alkyl ether sulfate mixture of compounds having a degree of ethoxylation greater than 8.

21. The composition of claim 20 wherein component (c) is selected from the group consisting of the alkali metal pyrophosphates, tripolyphosphates, nitrilotriacetates, and mixtures thereof.

22. The composition of claim 21 wherein the mean diameter of the submicron calcium carbonate particles in the discrete granule is from about 0.01 to about 0.25 micron.

23. The composition of claim 22 further consisting essentially of from about 5% to about 60% by weight of the finished product of an additional detergent builder selected from the group consisting of alkali metal carbonates, bicarbonates, and sesquicarbonates, and mixtures thereof.

24. The composition of claim 23 wherein the additional detergent builder is sodium carbonate.

25. The composition of claim 22 wherein the weight ratio of component (b) to the calcium carbonate in the discrete granule is from about 50:1 to about 1:1.

26. The composition of claim 25 wherein the ratio of $M_2O:SiO_2$is from about 1:2.4 to 1:3.5

27. The composition of claim 26 wherein component (c) is present at from about 10% to about 60% by weight.

28. The composition of claim 27 wherein component (c) is selected from the group consisting of alkali metal pyrophosphates and tripolyphosphates, and mixtures thereof.

29. The composition of claim 28 wherein component (b) is sodium carbonate and component (c) is sodium pyrophosphate.

30. The composition of claim 29 wherein the $M_2O:SiO_2$ ratio is from about 1:2.6 to 1:3.3 and M is sodium.

31. The composition of claim 30 wherein the mean diameter of the submicron calcium carbonate particles in the discrete granule is from about 0.01 micron to about 0.10 micron and the weight ratio of sodium carbonate to the calcium carbonate in the discrete granule is from about 10:1 to about 2:1.

32. A granular detergent composition consisting essentially of:

a. from about 0.5% to about 50% by weight of submicron calcium carbonate particles;

b. from about 5% to about 70% by weight of a builder selected from the group consisting or the alkali metal carbonates, bicarbonates, and sesquicarbonates and mixtures thereof;

c. from about 5% to about 70% by weight of a builder selected from the group consisting of the alkali metal pyrophosphates, tripolyphosphates, and nitrilotriacetates and mixtures thereof;

from 5% to about 40% by weight of an alkali metal silicate having an $M_2O:SiO_2$ ratio of from about 1:2.4 to about 1:3.5;

e. from about 2% to about 15% by weight alkyl ether sulfates of the formula

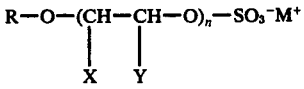

wherein R is an alkyl having from about 10–20 carbon atoms; $x$ and $y$ are selected from the group consisting of hydrogen, lower alkyls, and hydroxyl radicals and mixtures thereof; M is an alkali metal; and $n$, the degree of ethoxylation, is an integer from 1 to 30;

f. from about 2% to about 15% by weight of an alkali metal salt of an alkyl sulfate wherein the alkyl group has from about 2% to about 15% by weight of an alkali metal salt of an alkyl benzene sulfonate wherein the alkyl group has from 9–15 carbon atoms;

wherein component (a) and component (b) are combined to from one discrete granule and components (c), (d), (e), (f) and (g) form a second discrete granule wherein the second discrete granule is dried to a moisture content of less than 7% by weight.

33. The composition of claim 32 wherein the mean diameter of the submicron calcium carbonate particles in the discrete granule is from about 0.01 to about 0.25 micron.

34. The composition of claim 33 wherein component (b) is sodium carbonate and component (c) is sodium pyrophosphate.

35. The composition of claim 34 wherein component (e) is of the following description: an alkyl ether sulfate mixture wherein $x$ and $y$ are hydrogen, M is selected from the group consisting of sodium and potassium, the average number of carbon atoms is R within said alkyl ether sulfate mixture varying between 12 and 16 and $n$ the average degree of ethoxylation of said mixture varying between 1 and 4 moles of ethylene oxide; said mixture comprising from about 0% to 20% by weight of said alkyl ether sulfate mixture of compounds with R containing 12 or 13 carbon atoms; from about 60% to 100% by weight of said alkyl ether sulfate mixture of compounds with R containing 14, 15 and 16 carbon atoms; from about 0% to 20% by weight of said alkyl ether sulfate mixture of compounds with R containing 17, 18 or 19 carbon atoms, from about 3% to 30% by weight of said alkyl ether sulfate mixture of compounds having a degree of ethoxylation of zero; from about 45% to 90% by weight of said alkyl ether sulfate mixture of compounds having a degree of ethoxylation of from 1 to 4; from about 10% to 25% by weight of said alkyl ether sulfate mixture of compounds having a degree of ethoxylation of from to 8; and from about 0.1% to 15% by weight of said alkyl ether sulfate mixture of compounds having a degree of ethoxylation greater than 8.

36. The composition of claim 35 wherein the weight ratio of the sodium carbonate to the calcium carbonate in the discrete granule is from about 50:1 to about 1:1.

37. The composition of claim 36 wherein component (d) is sodium silicate with an $Na_2O:SiO_2$ weight ratio of from about 1:2.6 to about 1:3.3.

* * * * *

UNITED STATES PATENT OFFICE

CERTIFICATE OF CORRECTION

Patent No. 4,040,988 Dated August 9, 1977

Inventor(s) Richard W. Benson et al.

It is certified that error appears in the above-identified patent and that said Letters Patent are hereby corrected as shown below:

Column 6, line 39, "85" should be -- 35% --.
Column 10, line 38, "sultonates" should be -- sulfonates --.
Column 11, line 50, "preformance" should be -- performance --.
Column 14, line 20, "chin" should be -- chain --.
Column 14, line 21, "$NA_2O:SiO_2$" should be -- $Na_2O:SiO_2$ --.
Column 15, line 32, "descrete" should be -- discrete --.
Column 18, line 46, after "has from" insert -- 10-20 carbon atoms;
(g) from --
Column 18, line 51, "from" should be -- form --.
Column 20, line 3, after "of from" insert -- 5 --.

Signed and Sealed this

Twenty-eighth Day of March 1978

[SEAL]

Attest:

RUTH C. MASON
Attesting Officer

LUTRELLE F. PARKER
Acting Commissioner of Patents and Trademarks